US007228795B2

(12) United States Patent
Contreras et al.

(10) Patent No.: US 7,228,795 B2
(45) Date of Patent: Jun. 12, 2007

(54) LAUNDRY TIE-OUT STATION

(76) Inventors: Luis C. Contreras, 6209 E. Rocking Horse Way, Orange, CA (US) 92869; Jack L. Hoffa, 512 Juniper St., Brea, CA (US) 92821

( * ) Notice: Subject to any disclaimer, the term of this patent is extended or adjusted under 35 U.S.C. 154(b) by 133 days.

(21) Appl. No.: 11/202,122

(22) Filed: Aug. 12, 2005

(65) Prior Publication Data

US 2007/0034280 A1 Feb. 15, 2007

(51) Int. Cl.
*B65B 13/02* (2006.01)
*B65B 13/28* (2006.01)

(52) U.S. Cl. ..... 100/31; 140/93 A; 140/93.6

(58) Field of Classification Search ..... 100/8, 100/13, 18, 20, 21, 22, 23, 31; 140/93 A, 140/93.6, 118; 53/138.6, 138.8, 583
See application file for complete search history.

(56) References Cited

U.S. PATENT DOCUMENTS 4,054,160 A 10/1977 Knudsen
4,907,392 A * 3/1990 Knudsen ..... 53/138.8
4,940,174 A 7/1990 Parker
5,238,122 A 8/1993 Hart
5,687,851 A 11/1997 Schonenberger
6,050,421 A 4/2000 Hansen
6,928,788 B1 * 8/2005 Lai ..... 53/138.8

* cited by examiner

*Primary Examiner*—Jimmy Nguyen
(74) *Attorney, Agent, or Firm*—Gordon K. Anderson

(57) ABSTRACT

An existing tying machine (20) is modified by the addition of components to produce a self contained laundry tie-out station (10). The components for the modification include a linear slide support yoke frame (22), attached on top of the tying machine's component mounting platform (24) with a pneumatic linear slide unit (34) mounted on top. A hanger slide rod assembly (40) is attached to the mounting face of the linear slide unit for retaining a selected group of hangers (36) containing laundered clothing (36'). Conveyer feed lines are aligned with distal ends of the recessed hanger slide rod (42) when in an at rest position. A pneumatic system operates the slide unit and controls are integrated into the tying machines existing electrical system. The invention draws the group of hangers into the tying machine where it bunches the hangers together and electromechanically binds the group with a twist tie. The hangers are then returned to their original position after a timed interval and the hangers not requiring tying may continue to move along the conveyer.

19 Claims, 8 Drawing Sheets

LAUNDRY TIE-OUT STATION

TECHNICAL FIELD

The present invention relates to tying machines in general. More specifically to an improvement in an existing tying machine which adds the components to produce a laundry tie-out station for tying together a number of laundry articles on hangers.

BACKGROUND ART

Previously, many types of systems have been used in endeavoring to provide a laundry tie-out station to sort and tie together a selected group of laundry articles by connecting the hangers with a twist tie. Some prior art has developed systems that are very complex and sort and tie automatically while others simply use an existing conveyor system and manually sort the items by hand and attach them together with a conventional tying machine.

The prior art listed below did not disclose patents that possess any of the novelty of the instant invention; however the following U.S. patents are considered related:

| Patent Number | Inventor | Issue Date |
|---|---|---|
| 4,054,160 | Knudsen | Oct. 18, 1977 |
| 4,940,174 | Parker | Jul. 10, 1990 |
| 5,238,122 | Hart | Aug. 24, 1993 |
| 5,687,851 | Schonenberger | Nov. 18, 1997 |
| 6,050,421 | Hansen | Apr. 18, 2000 |

Knudsen in U.S. Pat. No. 4,054,160 is for the tying machine in which the improvement is directed. The improvement adds the capabilities of incorporating equipment converting the machine into a tie-out station which ties a bundle of hangers together that are hanging on a conveyer rail.

U.S. Pat. No. 4,940,174 issued to Parker teaches a garment supporting system in which a garment hanger, having an aperture in a hook like neck, is employed in combination with an elongated flexible tie. The tie has a less flexible segment located along its length and a gripping ring located at one end of the tie. A ring is located on the end opposite of the flexible segment permitting transporting a number of garments in a controlled manner.

Hart, in U.S. Pat. No. 5,238,122 discloses a method and apparatus for sorting garments of different types and sizes. The garments are sorted according to different selection criteria and put together into chosen delivery groups. Sorting is accomplished in two steps first in pre-groups and second containing a specific size and type with all other groups combined, Schonenberger in U.S. Pat. No. 5,687,851 teaches a method of sorting articles in groups in a conveyer system. A first conveyer circle with an identification source recognizes predetermined number of articles individually. Independent of the loaded state of the first circle, a second conveyer circle sorts the balance as soon as the first sorting step has been identified.

U.S. Pat. No. 6,050,421 issued to Hansen is for an automated laundry sorting system with finished items on hangers tagged with electronic identification devices allowing sorting into predetermined groups. The improvement includes an automatic joining apparatus for separating the groups from each other and then physically joining them together with a twist tie machine. The groups representing a single faction such as garments belonging to a particular customer.

DISCLOSURE OF THE INVENTION

While automated systems have been developed that sort and batch laundered garments and even attach the batches together with twist tie tape the initial cost of such equipment is prohibitive to many laundries. A common method used by various laundry's when it is required to batch a group of garments according to the customer or individual is to hand select the garments that are already arranged on a hanger and hand carry them to a tying machine and attach the group together at the twisted portion of the wire hanger.

This manual procedure described above is effective, however, it is also labor intensive therefore, a primary object of the invention is to save labor and increase production by using a tying machine that has the capabilities of not only accomplishing the tying procedure but also may act as a tie-out station actually drawing the selected group of hangers containing laundered clothing into the machine and returning the tied group to the original position. This action is accomplished by adding the necessary components to a machine that has already been designed and has a proven track record over the years. Obviously the cost of the improvement is minimal compared to a complex sorting system.

An important object of the invention eliminates injuries to workers over a long period of time as when using the instant tie-out station the worker does not have to lift a large bundle of hangers containing the garments to accomplish the tying procedure. When the invention is used in conjunction with a conveyer, the hangers are simply slid across a recessed slide rod and the operator presses the foot switch which draws the selected group into the machine and returns to the original position after a two second delay, where the bundled clothing may be removed or continue along the conveyer as desired.

Another object of the invention is realized when the tie-out station is used in conjunction with a conveyer system as the recessed hanger slide rod may be aligned in either a right to left or left to right direction with the conveyer feed lines or rails. The direction may be selected in the field at the time of installation according to which mounting holes are selected.

Mounting the invention is easily accomplished when employed with a conveyer system as conventional C-clamps may be attached to the two support rods extending from the bottom of the tie-out station with support pipes connected to overhead support beams in the customary manner. In the event a conveyer system is not utilized legs may be added to the two support rods with tee's or C-clamps where bundling is required in laundries and establishment on a small scale.

Still another object employs the use of a twist tie machine that is well known in the art and has been marketed in this country for decades. This object is particularly advantageous in that the basic tying apparatus is well proven and the addition of the equipment to alter the machine into a tie-out station is easy to accomplish and cost effective. This modification to an existing tying machine is simply accomplished with minimal parts replacement and modification.

A final object of the invention is that the pneumatic system requirements for the tie-out station modification are well within conventional pressures and flow rates that are currently available in most cleaning facilities within this country.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
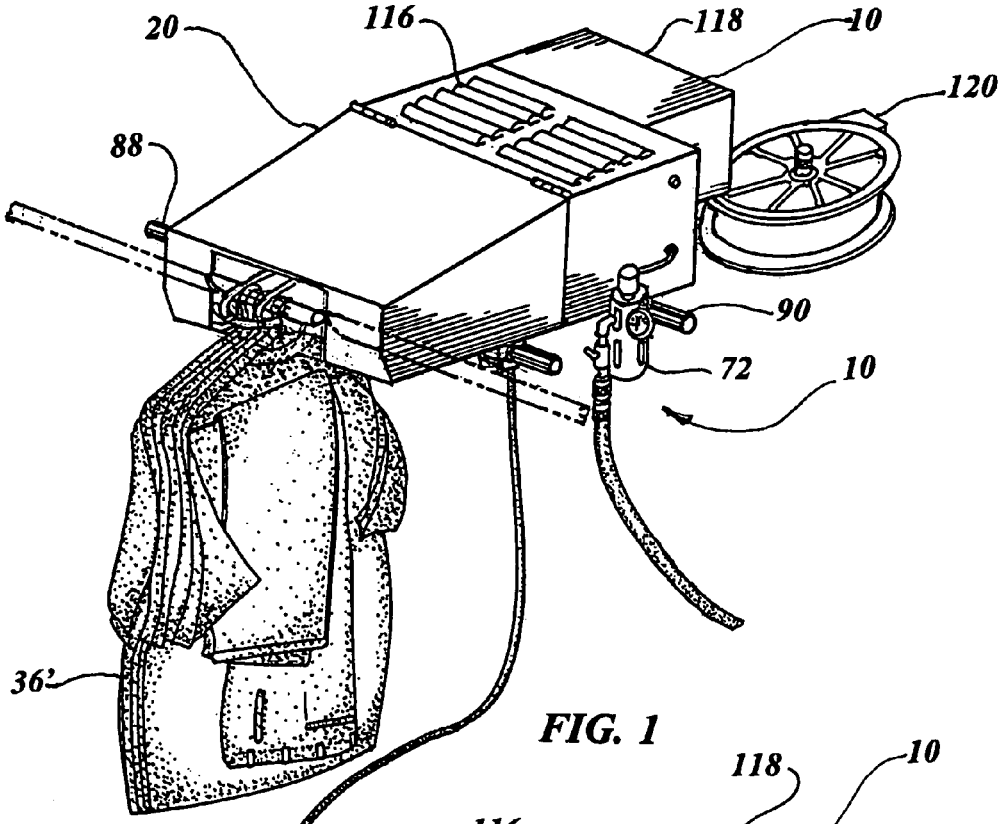
FIG. 1 is a partial isometric view of the preferred embodiment with a group of laundered shirts on hangers resting on the hanger slide rod.

The best mode for carrying out the invention is presented in terms of a preferred embodiment. This preferred embodiment is shown in FIGS. 1 thorough 40 and is comprised of a laundry tie-out station 10 that employs a tying machine 20 that has been improved to include components that expand its ability to incorporate the functional capabilities of a laundry tie-out station. The tying machine 20 preferably utilized is of the type having means for twist-tying articles, with an adjustable opening to receive the articles to be tied within the opening, means for adjusting the opening to control the metered length of a twist-tie ribbon for tying objects of various sizes, and means for adjusting the opening of the machine for centering objects of various sizes to be tied, in addition the tying machine must of necessity have a component mounting platform integral therewith.

Figure 41:
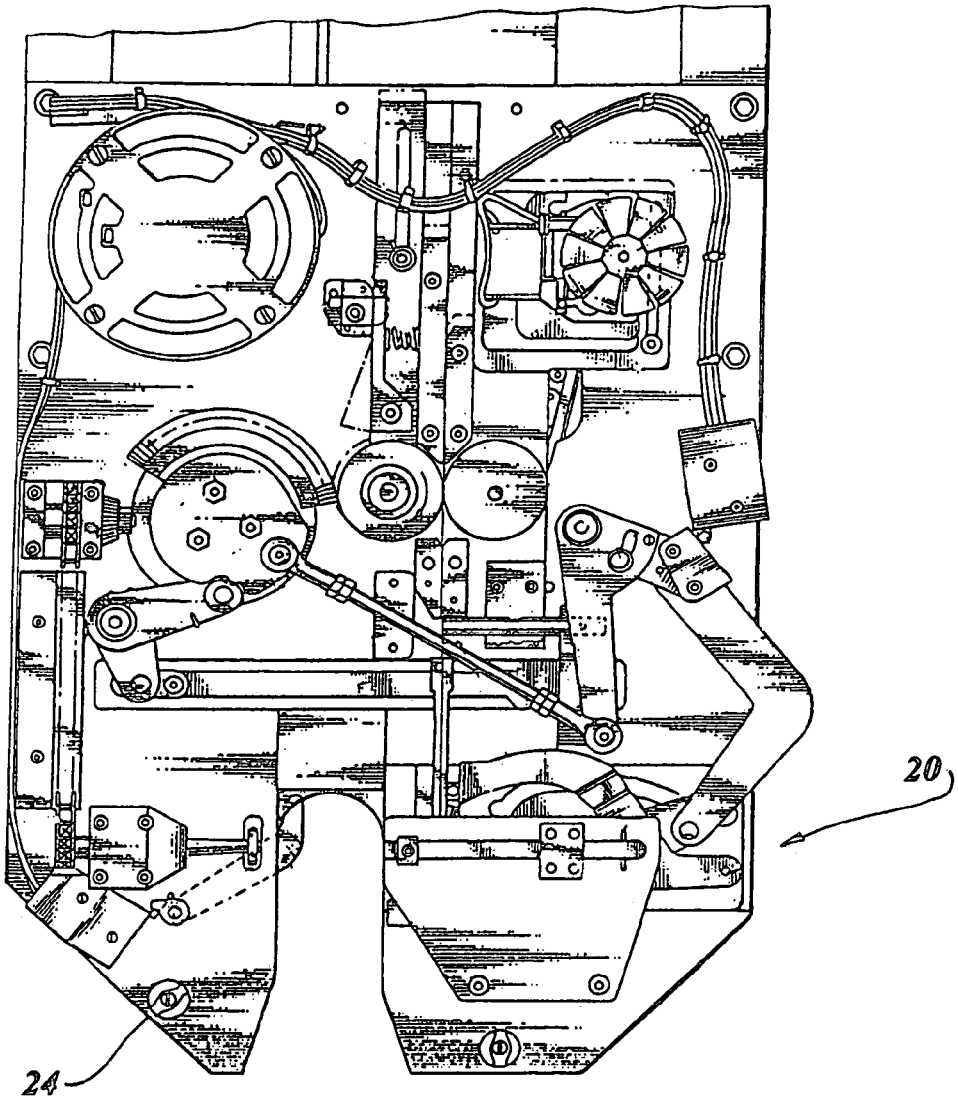
FIG. 41 PRIOR ART
FIG. 41 is a plan view of the existing prior art tying machine component mounting platform as illustrated in the prior art patent drawings.
Figure 42:
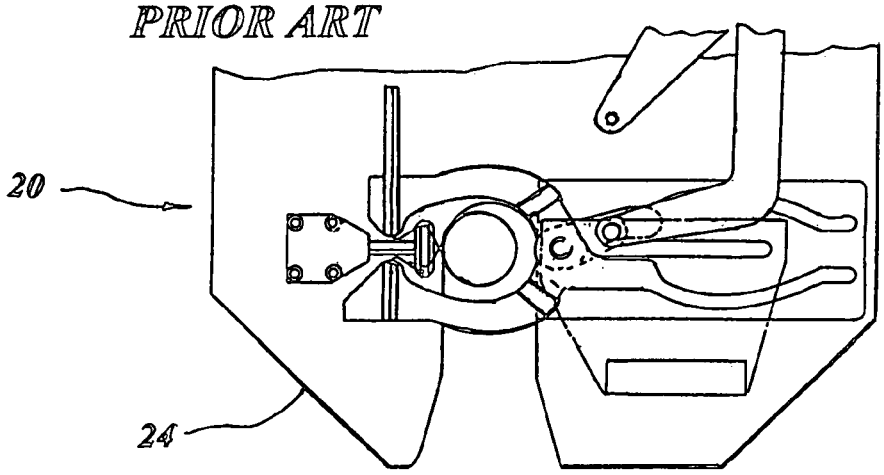
FIG. 42 PRIOR ART
FIG. 42 is a plan view of the existing prior art tying machine tying forming scissors moved to the fully extended position at the tying station with a twist tie article positioned at the tying station.

While the components required are specific to a particular tying machine the same approach may be made to alter almost any machine made for bag-in-box and flow-through operations. The precise tying machine 20 to which the invention is presently directed, is the Model XL-2so called "Tie-Matic" heavy duty model manufactured by PLAS-TIES of Tustin Calif. which was protected by U.S. Pat. No. 4,054,160 issued on Oct. 18, 1977. Obviously some updating has been accomplished in the years since the patent was originally issued however the basic criteria of the patent still apply. FIGS. 41 and 42 illustrate the prior art tying machine's component mounting platform 24 along with the appropriate components as it was originally patented.

Figure 8:
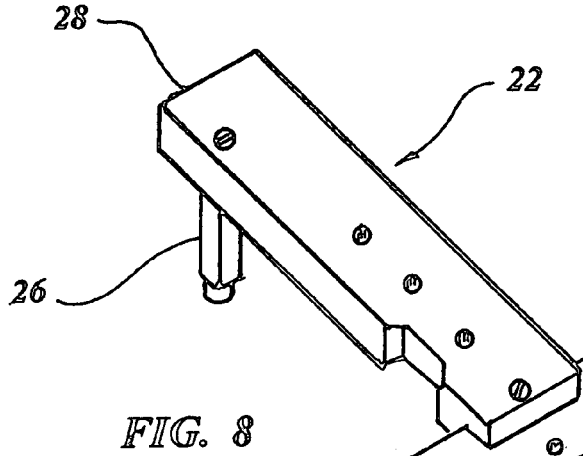
FIG. 8 is a partial isometric view of the liner slide support yoke frame assembly, shown completely removed from the improvement for clarity.
Figure 9:
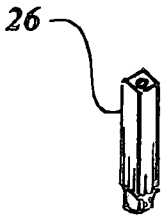
FIG. 9 is a partial isometric view of the support column, shown completely removed from the invention for clarity.
Figure 11:
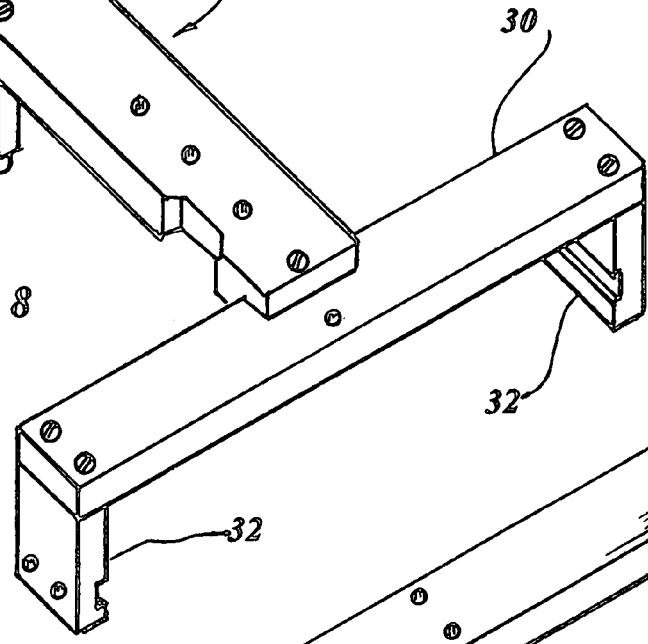
FIG. 11 is a partial isometric view of the cross member plate, shown completely removed from the invention for clarity.
Figure 11:
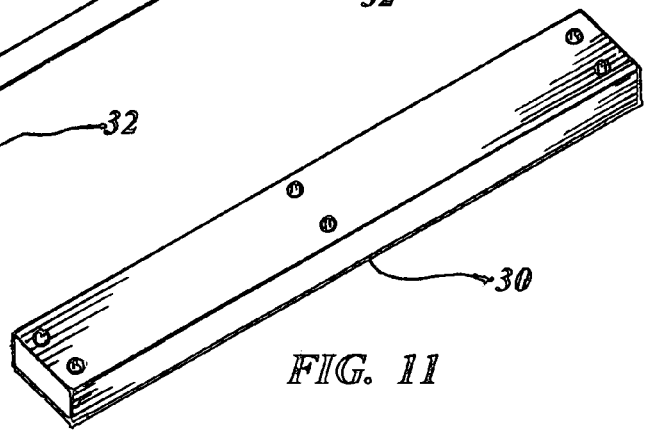
Figure 10:
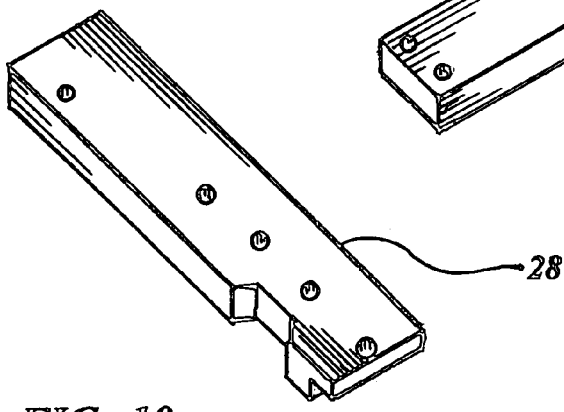
FIG. 10 is a partial isometric view of the linear slide mounting plate, shown completely removed from the invention for clarity.
Figure 13:
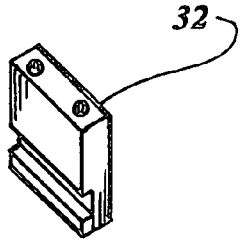
FIG. 13 is a partial isometric view of the right side support plate, shown completely removed from the invention for clarity.
Figure 12:
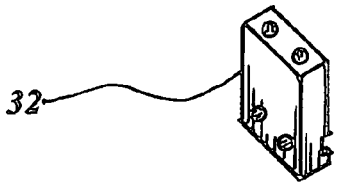
FIG. 12 is a partial isometric view of the left side support plate, shown completely removed from the invention for clarity.

The components added to the existing tying machine 20 include a linear slide support yoke frame 22 that is attached on top of the tying machine component mounting platform 24. The support yoke frame 22 is illustrated by itself in FIG. 8 with its components shown individually in FIGS. 9-13 and installed on the platform 24 in FIGS. 3 and 5. The support yoke frame 22 consists of a support column 26 that is attached to the component mounting platform 24 in alignment with the platform throat near the back edge. A linear slide mounting plate 28 rests on the support column 26 on one end and a cross member plate 30 is connected to the slide mounting plate 28. A pair of identical opposed side support plates 32 interface with adjoining sides of the cross member plate 30 on the top and attach to the sides of the component mounting platform 24 on the bottom, providing a suitable raised surface for mounting a pneumatic linear slide unit 34. It will be noted that the support yoke frame 22 serves two purposes, first it raises the slide unit 34 above the existing mechanism for achieving the twist tie operation and second it locates clothing hangers 36 that are grouped to be tied in the proper vertical position.

It should also be understood that the construction techniques illustrated are not to be construed as being the only type of structure that may be used, as formed sheet metal, castings or any other fabrication method may be employed with equal ease.

The pneumatic linear slide unit 34, disposed on the linear slide support yoke frame 22, draws a selected group of hangers 36 into the tying machine 20 as noted above. The linear slide unit 34 is preferably the double acting piston type with hydraulic shock absorbers providing end position cushioning. While other types of pneumatic equipment may be used, the slide unit 34 is ideal as it has a mounting face 38 that is convenient for attachment purposes and it further has an integral slide member that remains on the same plane regardless of its position. The ancillary shock absorbing capabilities are useful to cushion the piston travel when retracting the selected group of hangers 36. Travel from the fully extended position to the retracted position is smooth and may be adjusted in speed to provide an even movement so as to not jolt the combined hangers 36 from the surface upon which they are resting.

Figure 22:
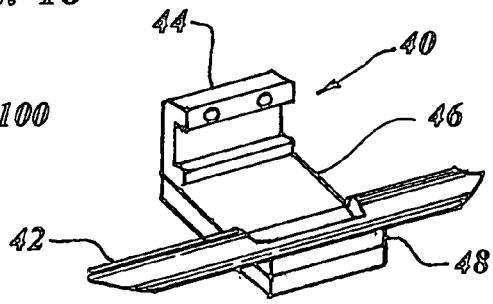
FIG. 22 is a partial isometric view of the recessed hanger slide rod assembly, shown completely removed from the invention for clarity.
Figure 23:
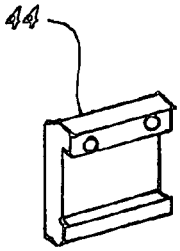
FIG. 23 is a partial isometric view of the hanger slide rod support plate, shown completely removed from the invention for clarity.
Figure 24:
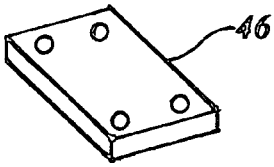
FIG. 24 is a partial isometric view of hanger slide rod extension plate, shown completely removed from the invention for clarity.
Figure 25:
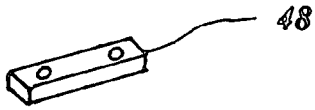
FIG. 25 is a partial isometric view of the hanger slide rod spacer plate, shown completely removed from the invention for clarity.
Figure 26:
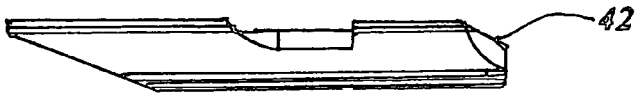
FIG. 26 is a partial isometric view of the recessed hanger slide rod, shown completely removed from the invention for clarity.
Figure 27:
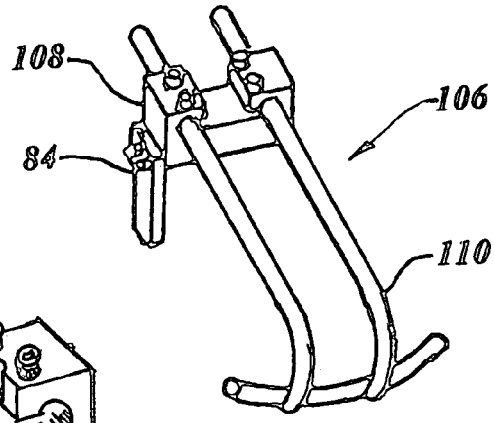
FIG. 27 is a partial isometric view of the hanger pull in safety boom, shown completely removed from the invention for clarity.
Figure 28:
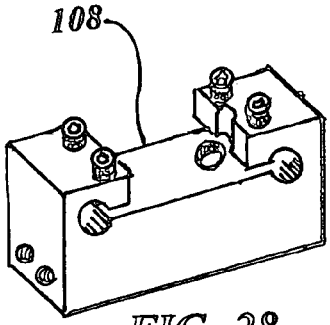
FIG. 28 is a partial isometric view of the safety boom bracket, shown completely removed from the invention for clarity.
Figure 29:
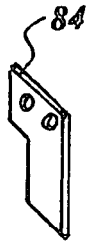
FIG. 29 is a partial isometric view of the tying machine switch activating arm, shown completely removed from the invention for clarity.

A hanger slide rod assembly 40, includes a horizontally positioned recessed hanger slide rod 42, as shown in FIG. 22, is attached to the pneumatic linear slide unit mounting face 38 and functions to retain a selected group of hangers 36 containing laundered clothing 36'. The hanger slide rod assembly 40 consists of a hanger support plate 44 that is rigidly connected to the front of the linear slide unit 34 with a hanger slide rod extension plate 46 attached beneath forming an angle bracket. A hanger slide rod spacer plate 48 is attached to the distal end of the hanger slide rod extension plate 46, as shown in FIG. 22. The recessed hanger slide rod 42 is attached to the top surface of the spacer plate 48 with the hanger slide rod 42 having its recess positioned on the top surface. It will be noted that the recess, as depicted best in FIG. 26, has sufficient depth to retain a group of hangers 36 in a secure manner. The recessed hanger slide rod 42 is preferably fabricated of acetal homo-polymer under its trade name DELRIN or some other acceptable thermoplastic material having similar properties.

It is also understood that the construction techniques illustrated in FIGS. 22-25, are not necessarily the only type of structure that may be used, again as formed sheet metal, castings or any other fabrication methods employed.

Figure 5:
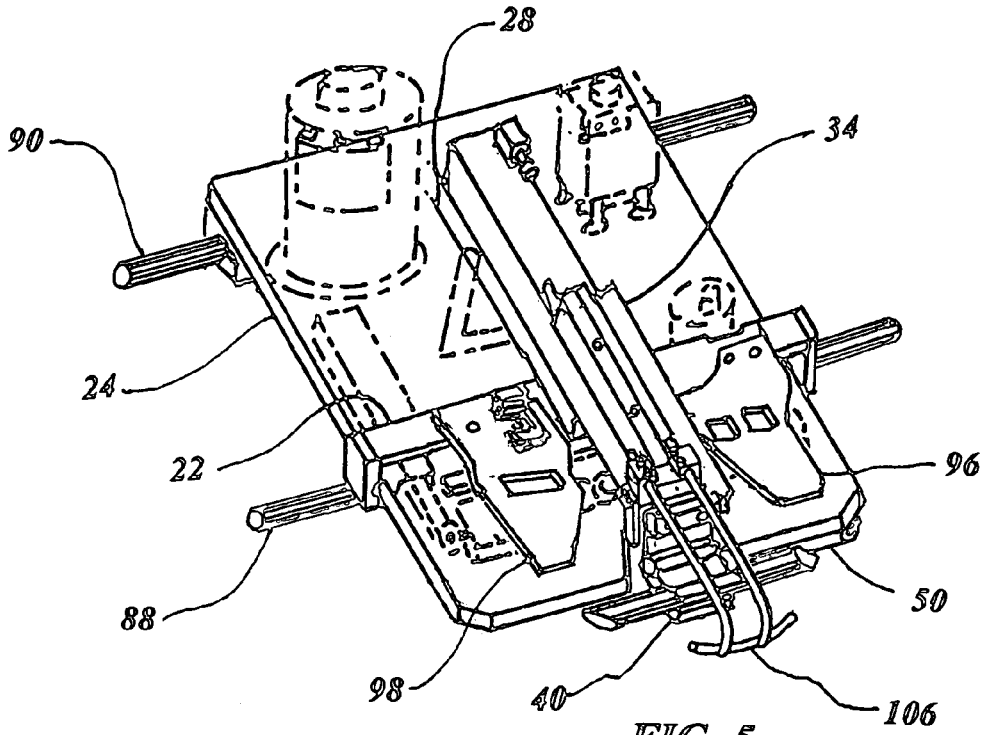
FIG. 5 is a fragmentary partial isometric view of the tying machine component mounting platform including the slide support yoke with the linear slide unit attached on top and the relevant elements mounted thereon.
Figure 6:
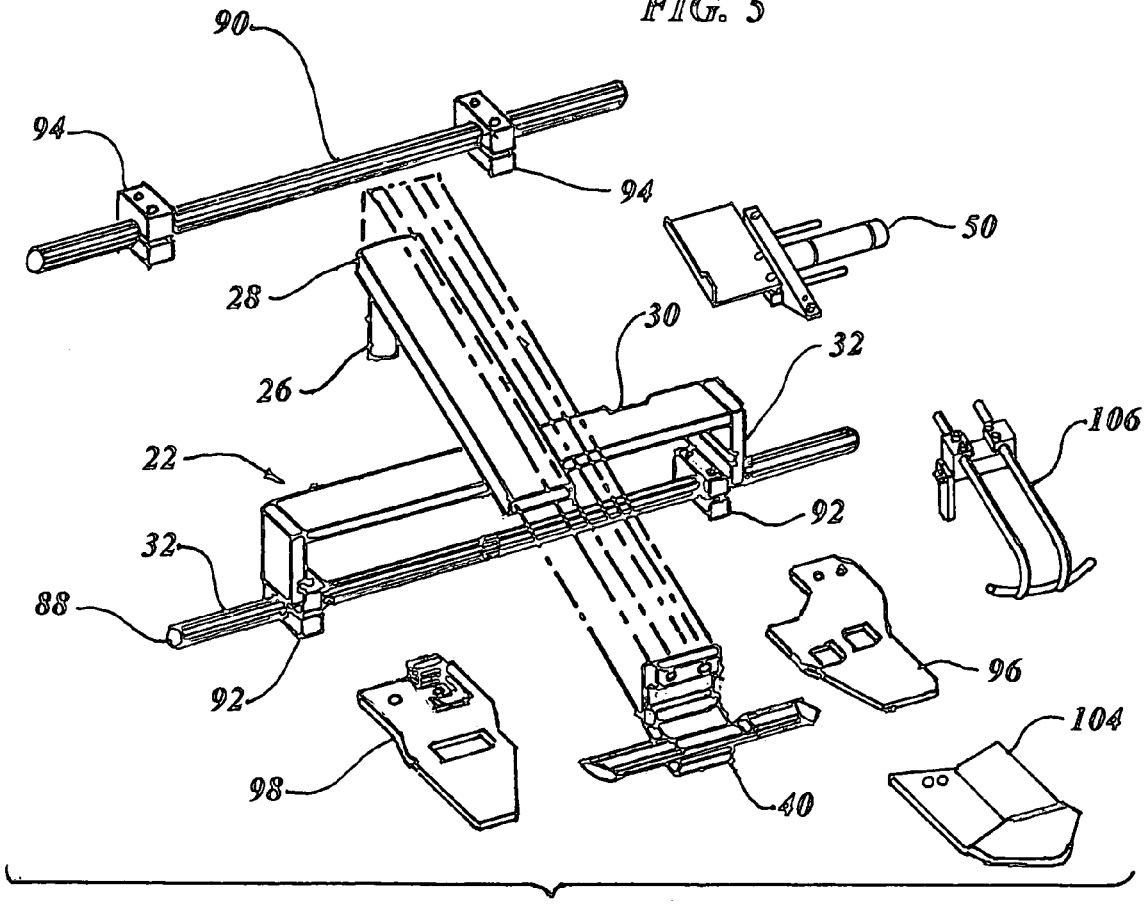
FIG. 6 is an exploded view of the mounting elements that attach the linear slide unit to the tying machines component mounting platform along with relevant elements.

A hanger nesting actuator 50 is mounted under the component mounting platform 24 as shown in FIGS. 5 and 6. The hanger nesting actuator 50 is optionally employed for bunching the selected group of hangers with laundered clothing 36' together permitting the tying machine 20 to tightly bind the hangers 36 with a twist tie and release the hangers 36 permitting the hanger slide rod 42 to return the bound hangers 36 to the original at rest position after the tying is completed.

As shown in FIGS. 31-40 the hanger nesting actuator 50 preferably consists of a pneumatic cylinder 52 with a cylinder mounting base 54 connected on one end, with the cylinder mounting base 54 including a pair of self-lubricating bushings 56. The cylinder mounting base 54 is configured to attach the pneumatic cylinder 52 under the tying machine component mounting platform 24 with conventional threaded fasteners or the like. A ram mounting plate 58, having an opposed pair of ram stabilizing arms 60 extend therefrom, permits stabilization of the pneumatic cylinder's integral ram 62. A bunching angle bracket 64 is connected on an upper surface of the ram mounting plate 58 with the stabilizing arms 60 penetrating the cylinder mounting base self-lubricating bushings 56. When the cylinder 52 is pneumatically actuated the ram 62 forces the bunching angle bracket 64 into contact with the selected group of hangers 36 compressing them together permitting the tying machine 20 to bind the hangers 36 tightly together with a twist tie.

Figure 7:
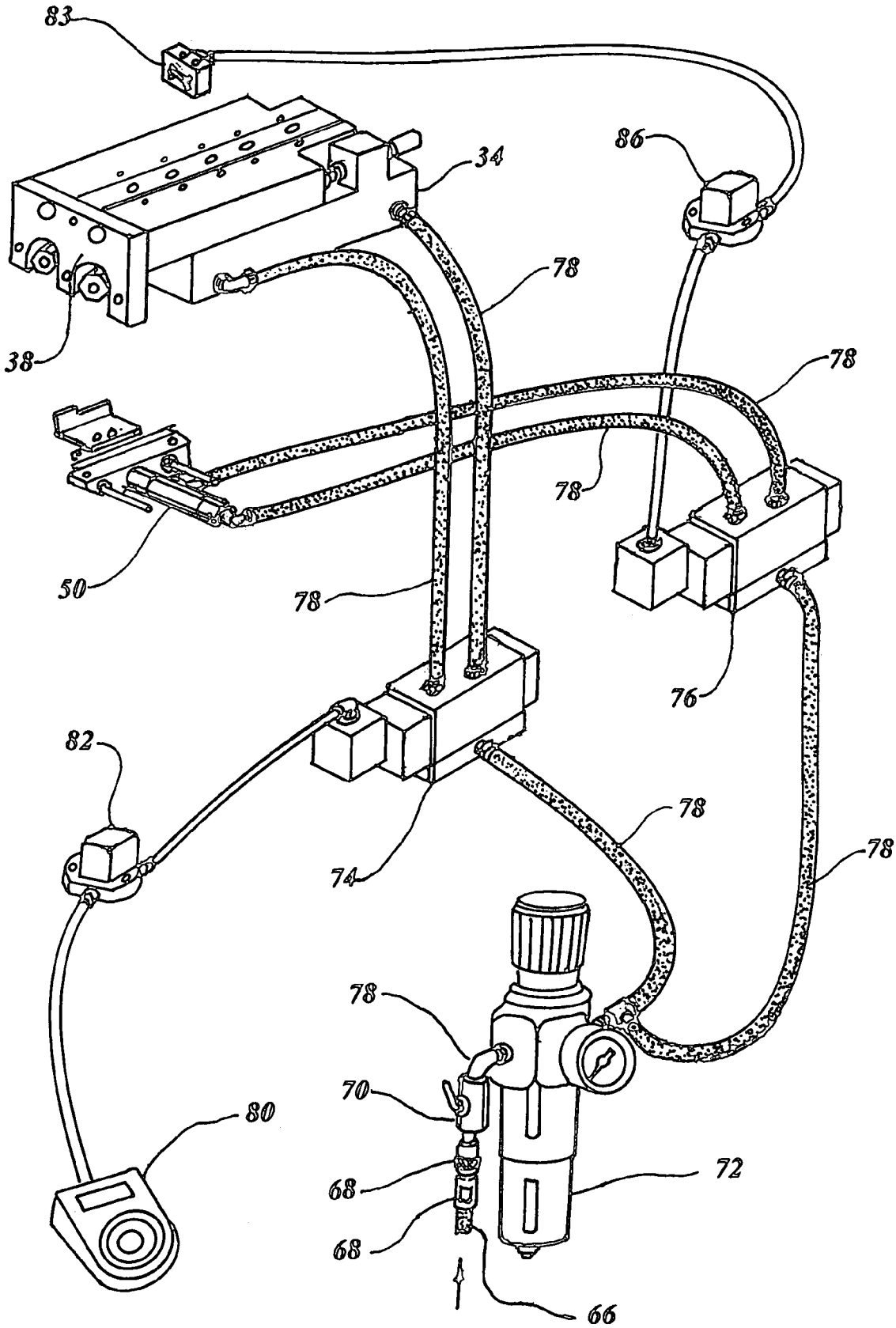
FIG. 7 is a partial pictorial schematic isometric view of the pneumatic system including its electrical components for actuating the laundry tie-out station.

A pneumatic system provides the power to actuate the linear slide unit 34 permitting the hanger slide rod assembly 40 to be drawn into the tying machine 20 and urged back to its original at rest position. The preferred pneumatic system is illustrated in FIG. 7 and consists of a pneumatic hose 66 for connecting to a compressed air source, a pneumatic quick connect hose coupling 68 attached to the hose 66 and pneumatic ball valve 70 connected to the coupling 68. A filter regulator 72 is in communication with the ball valve 70 on one side and a linear slide unit valve 74 on the other with the valve 74 controlling the action of the linear slide unit 34. The valve 74 introduces compressed air into one side of the linear slide unit cylinder to drive the slide unit cylinder piston into the retracted position permitting the hangers 36 to be attached together with a twist tie from the tying machine 20. The two position valve 74 relieves pressure from the driven side and introduces pressure to the opposite side of the piston to return the hanger slide rod assembly 40 to it's at rest position.

The filter regulator 72 is simultaneously in communication with a hanger nesting actuator valve 76 controlling the movement of the hanger nesting actuator 50 which forces the bunching angle bracket 64 into contact with the selected group of hangers 36 permitting the tying machine 20 to bind the hangers 36 tightly together with a twist tie as described previously. Obviously other fittings and interconnecting pneumatic tubing 78 are required as illustrated in FIG. 7 to complete the system.

The preferred pneumatic system utilizes standard pressures for operation such as 30 to 120 pounds per square inch (2 to 8 bar) 150 pounds per square inch (10 bar) maximum. The location of the hydraulic system is optional as the valve 74 along with its ancillary equipment may be installed at any convenient location. There are many other schemes and combination of components that would function in the same manner and therefore the invention is not necessarily limited to the approach described and shown.

Means for integrally controlling the tying machine 20 include actuating the pneumatic system, as selected by an operator, which pulls the hanger rod assembly 40 into the tying machine 20 with the linear slide unit 34, bunching and tying the selected group of hangers 36 together and returning the hanger slide rod assembly 40 to its at rest position after the cycle is completed.

The means of controlling the tying machine 20 consists of a momentary foot switch 80 which is electrically connected to a first time delay relay 82 which is electrically connected in series with the pneumatic linear slide unit valve 74 such that when an operator presses down on the foot switch 80 the pneumatic linear slide unit valve 74 energizes the linear slide unit 34 bringing the selected group of hangers 36 into contact with the tying machine 20 which automatically actuates by integral switching arrangements attaching a twist tie ribbon around the selected group of hangers 36. When the first time delay relay 82 has timed out, which is optionally set at two seconds, the linear slide unit 34 returns the hanger slide rod assembly 40 to its at rest position.

Independent of the above action a hanger nesting actuator switch 83, located above the cross member plate 30, is energized by a switch activating arm 84 basically positioned on the linear slide unit 34. The hanger nesting actuator switch 83 is wired in series with a second time delay relay 86. When the pneumatic linear slide unit 34 draws the selected group of hangers 36 into the tying machine the hanger nesting actuator switch 83 energizes the hanger nesting actuator valve 76 permitting the hanger nesting actuator 50 to urge the hangers 36 together sufficiently to allow the tying machine 20 to twist a tie ribbon around the hangers 36. After the second time delay relay 86 has timed out, preferably at two seconds, the hanger nesting actuator 50 returns to its normal retracted position.

Figure 14:
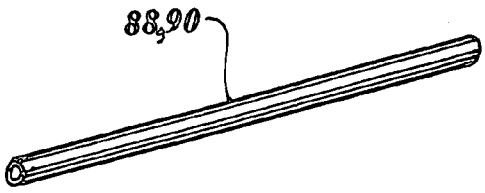
FIG. 14 is a partial isometric view of one of the support rods, shown completely removed from the invention for clarity.
Figure 15:
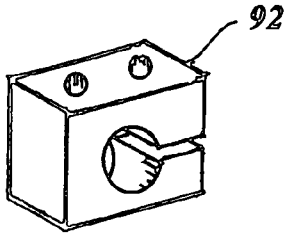
FIG. 15 is a partial isometric view of one of front support rod brackets, shown completely removed from the invention for clarity.
Figure 16:
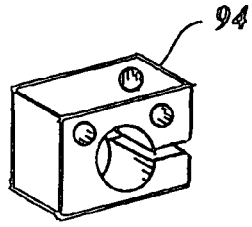
FIG. 16 is a partial isometric view of one of the rear support rod brackets, shown completely removed from the invention for clarity.

The laundry tie-out station 10 is intended to be used primarily with a laundry conveyer system; therefore the station incorporates a front support rod 88 and a rear support rod 90 that are attached under the tying machine 20 for mounting the laundry tie-out station 10 to conventional building support beams. The front support rod 88 is preferably connected to the bottom of the tying machine 20 with a pair of front support rod brackets 92 and the rear support rod 90 is connected with similar rear support rod brackets 94. The rods 88 and 90 are shown as one in FIG. 14, as they are identical, and likewise the support rod brackets 92 and 94 are illustrated as one in FIGS. 15 and 16 respectively although they are each configured right hand and left hand in mirror image. It will be noted that even though the rods 88 and 90 are best suited for hanging on conveyer systems, legs may be easily added to the extending ends with EMT tee's or similar pipe fittings with equal ease and dispatch.

Figure 3:
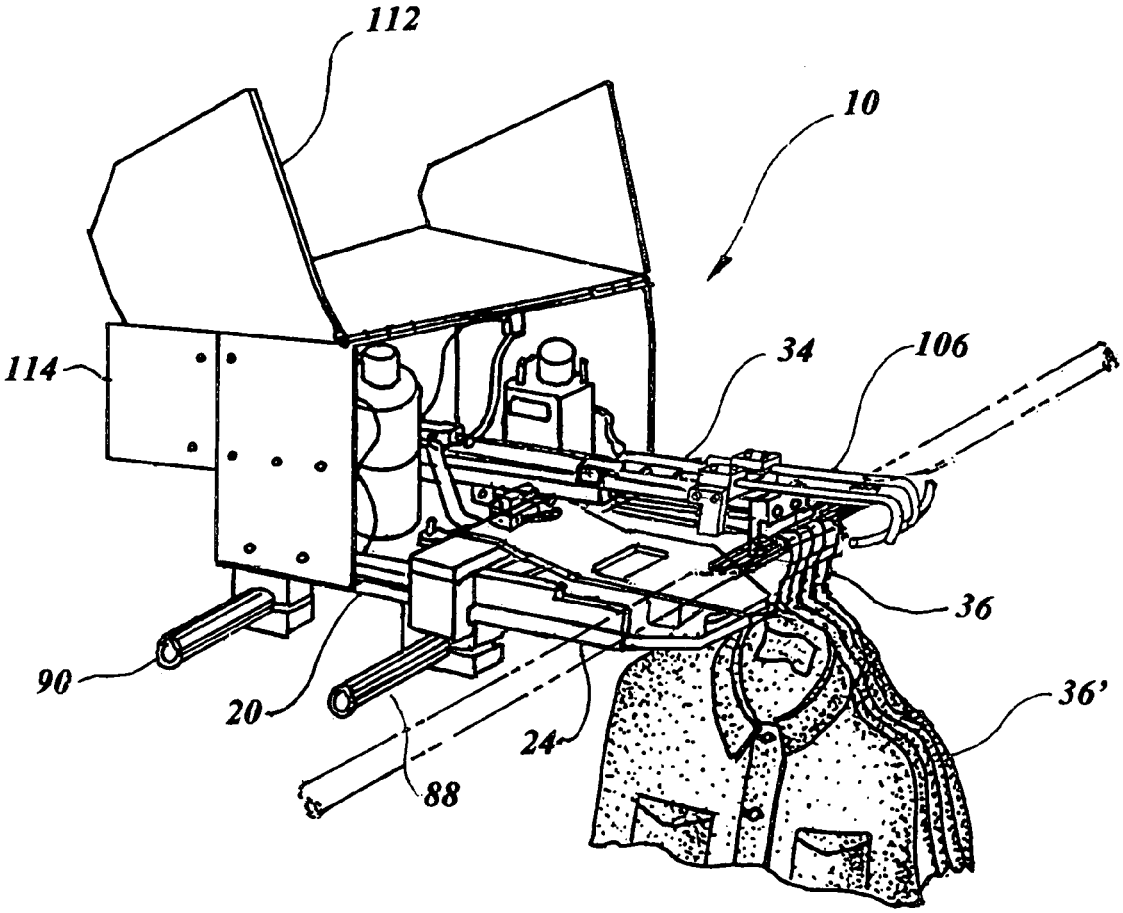
FIG. 3 is a fragmentary partial isometric view of the preferred embodiment with the front cover opened illustrating the mechanism inside and a portion of a conveyer system shown in phantom.
Figure 4:
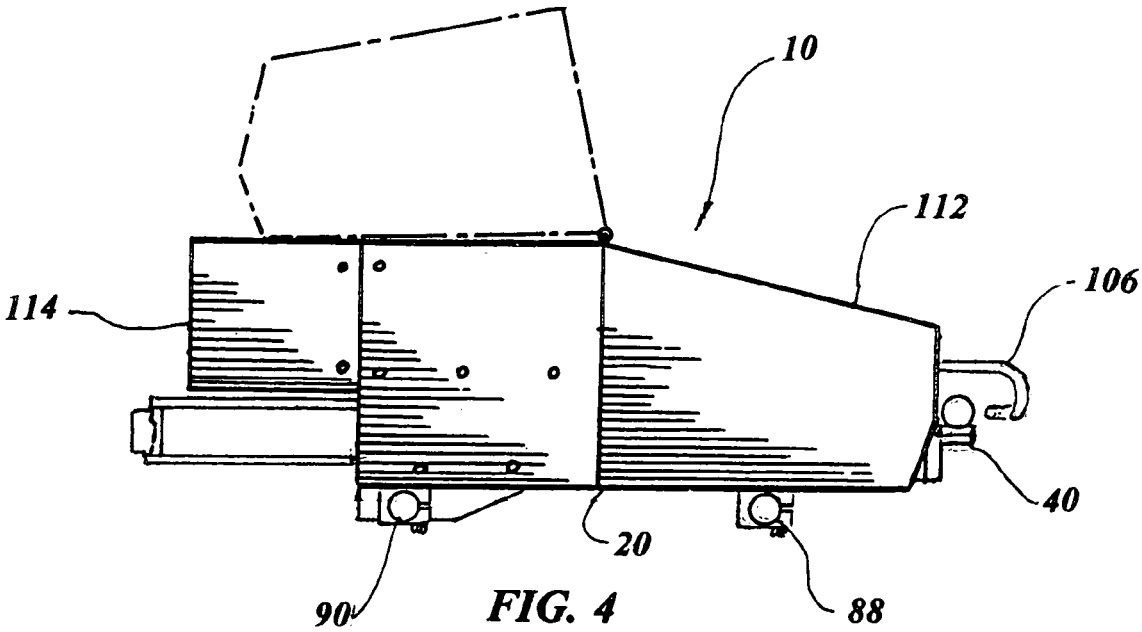
FIG. 4 is a side elevation view of the tying machine with the control box relocated and the front cover closed and the linear slide unit in the extended position. The front cover is also depicted in the open position in phantom.
Figure 17:
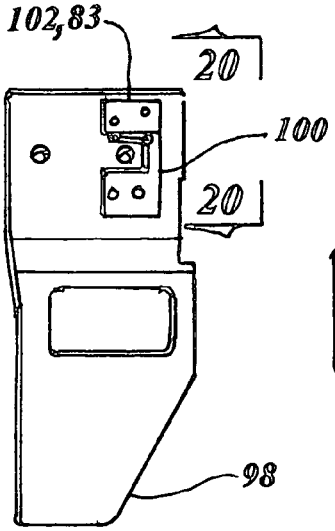
FIG. 17 is a partial isometric view of the left upper guide plate assembly, shown completely removed from the invention for clarity.
Figure 18:
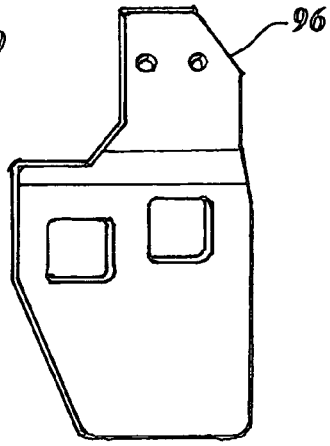
FIG. 18 is a partial isometric view of the right upper guide plate, shown completely removed from the invention for clarity.

In order to assure reliability, smoothly configured covers or guides are added to the tying machine 20 at the appropriate locations to isolate protruding elements. A right upper guide plate 96 is attached to the right top side of the linear slide support yoke frame 22 and a left upper guide plate 98 is attached to the left top side of the same linear slide support yoke frame 22. The shape and form of the plates 96 and 98 and their position over the component mounting platform 24 preclude contact with existing elements that are mounted on the upper surface. It will be noted that the left upper guide plate 98 contains a separate switch mounting plate 100 configured to orient the hanger nesting actuator switch 83 along with a relocated tying machine integral control switch 102 at the proper functional location. FIGS. 3, 5 and 6 illustrate the mounting location of the plates 96 and 98 with FIGS. 17 and 18 showing the detail of each plate 96 and 98.

Figure 19:
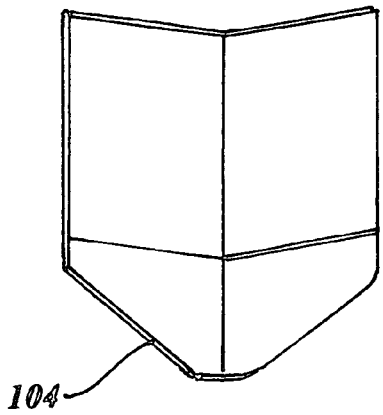
FIG. 19 is a partial isometric view of the hanger nesting actuator shield, shown completely removed from the invention for clarity.
Figure 20:
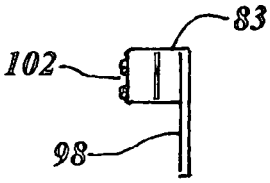
FIG. 20 is a side view taken looking onto the edge of FIG. 17 illustrating the left upper guide plate, switch mounting bracket, hanger nesting actuator switch, and the tying machine actuating switch.
Figure 21:
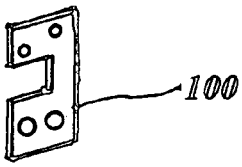
FIG. 21 is a partial isometric view of the switch mounting bracket, shown completely removed from the invention for clarity.

A hanger nesting actuator shield 104 is attached beneath the tying machine component mounting platform 24 to preclude contact with elements mounted thereon. The shield 104 is illustrated alone in FIG. 19 and in its approximate location in FIG. 6.

Figure 30:
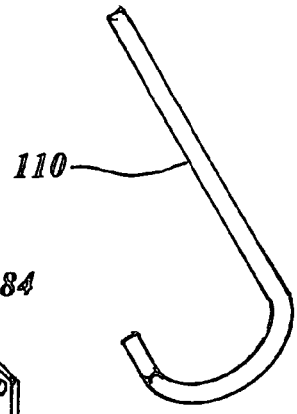
FIG. 30 is a partial isometric view of the safety boom weldment, shown completely removed from the invention for clarity.
Figure 31:
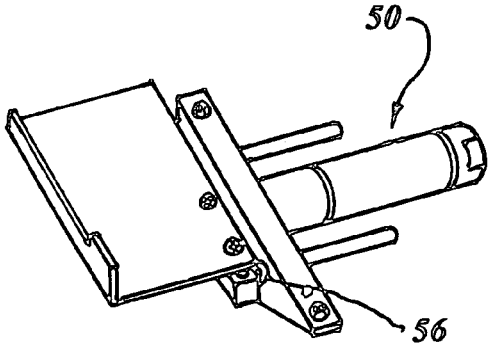
FIG. 31 is a partial isometric view of the hanger nesting actuator, shown completely removed from the invention for clarity.
Figure 32:
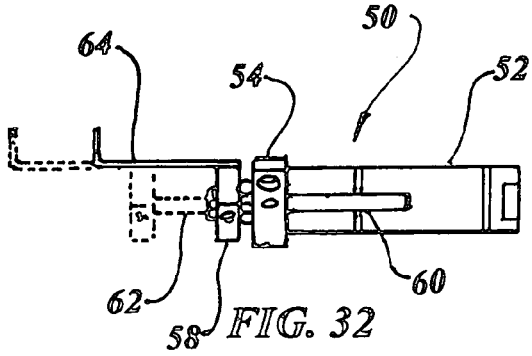
FIG. 32 is a side elevation view of the hanger nesting actuator, shown completely removed from the invention for clarity.
Figure 33:
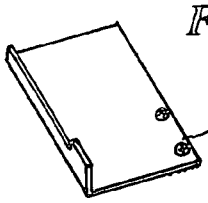
FIG. 33 is a partial isometric view of the hanger bunching angle bracket, shown completely removed from the invention for clarity.
Figure 34:
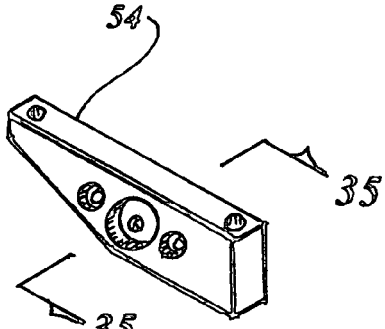
FIG. 34 is a partial isometric view of the ram mounting plate, shown completely removed from the invention for clarity.
Figure 35:
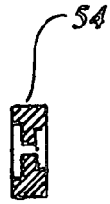
FIG. 35 is a cross sectional view taken along lines 35-35 of FIG. 34.
Figure 36:
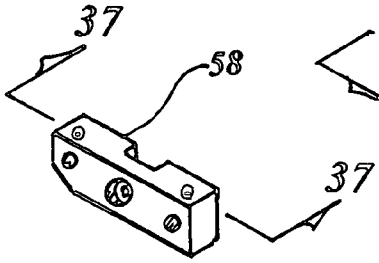
FIG. 36 is a partial isometric view of the cylinder mounting base, shown completely removed from the invention for clarity.
Figure 37:
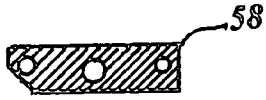
FIG. 37 is a cross sectional view taken along lines 37-37 of FIG. 36.
Figure 38:
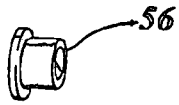
FIG. 38 is a partial isometric view of self-lubricating bushings, shown completely removed from the invention for clarity.
Figure 39:
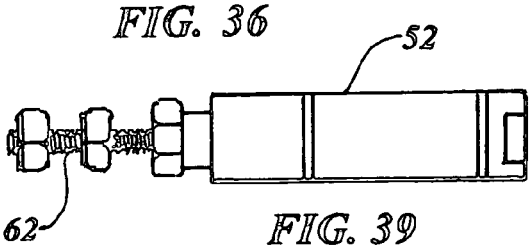
FIG. 39 is a side elevation view of the hanger nesting actuator pneumatic cylinder, shown completely removed from the invention for clarity.
Figure 40:
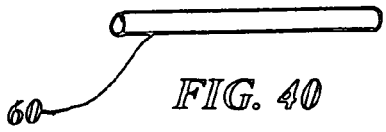
FIG. 40 is a partial isometric view of one of the stabilizing arms, shown completely removed from the invention for clarity.

A hanger pull-in safety boom 106 is attached to the top of the pneumatic linear slide unit 34 for assuring the selected group of hangers 36 are pulled into the tying machine 20 properly. The hanger pull-in safety boom 106 consists of a safety boom bracket 108, which has provision for attachment of the switch activating arm 84 as illustrated in FIGS. 27-30. FIG. 30 shows the detail of the safety boom weldment 110 which is adjustably attached to the safety boom bracket 108.

Figure 2:
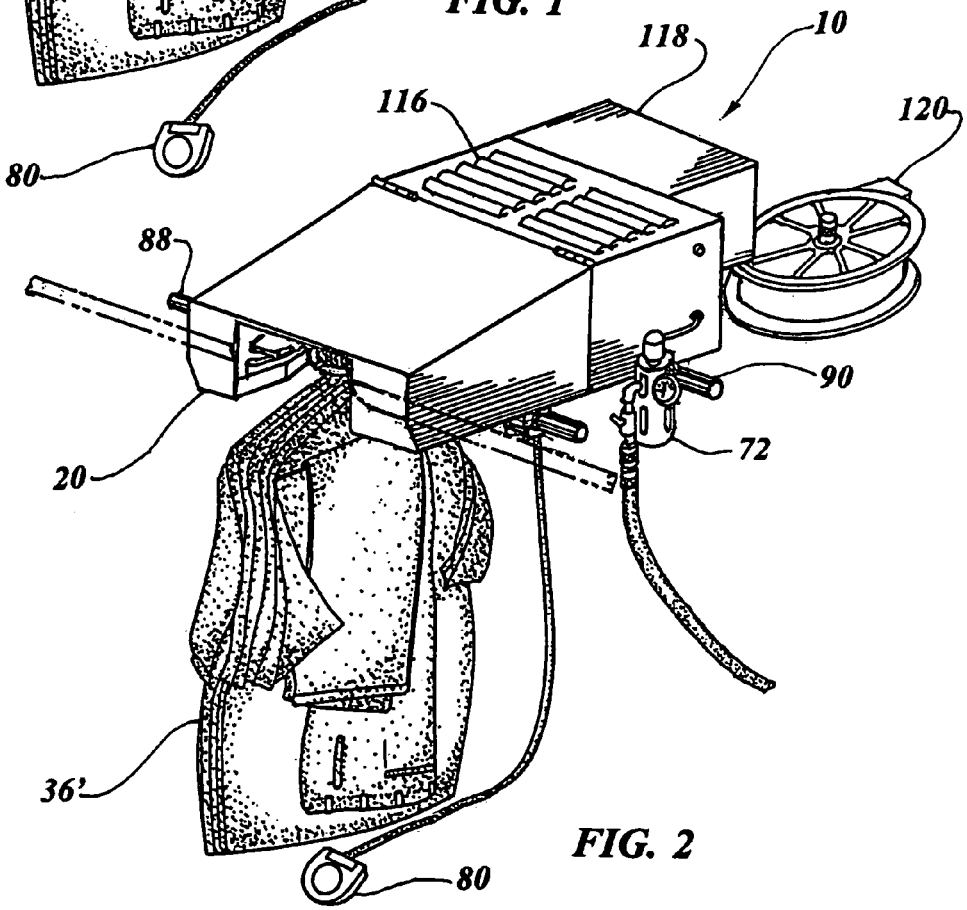
FIG. 2 is a partial isometric view of the preferred embodiment with a group of laundered shirts on hangers after being drawn into the tying machine and coupled together with a twist tie.

A few modifications to the tying machine 20 are required in the form of replacements or additions along with relocation of components to complete its transformation to a tie-out station 10. A replacement front cover 112 and a rear cover 114 are required to allow sufficient space to house the addition of the laundry tie-out station improvements. The covers 112 and 114 are basically the same shape except slightly larger and the rear cover 114 includes a plurality of louvers 116 on a top surface to provide air circulation within the tying machine 20. The tying machine's control box 118 is relocated to the rear instead of on top and is attached to a rear portion of the replacement rear cover 114. In order to provide room for the relocated control box 118, means are required to mount the roll of twist tie wire 120 in a horizontal position as illustrated in FIGS. 1-3.

In operation, pneumatic pressure is attached to the quick connect hose coupling 68. A selected group of hangers 36 containing laundered garments 36' that have been sorted are placed in the center front of the tying machine 20 on the recessed hanger slide rod 42. The operator depresses the foot switch 80 drawing the selected group of hangers 36, containing laundered clothing 36', into the tying machine 20 where it automatically bundles the hangers 36 with a twist tie and in two seconds returns the tied group to the original position where it is manually removed by the operator.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A laundry tie-out station which comprises, a tying machine for binding a selected group of hangers together with a twist tie, a pneumatic linear slide unit mounted on the tying machine for drawing the selected group of hangers into the tying machine, a hanger pull-in safety boom is attached to a top of the pneumatic slide unit for assuring the selected group of hangers are pulled into the tying machine properly, and a hanger slide rod attached to the pneumatic linear slide unit for supporting the selected group of hangers, permitting the tying machine to bind the hangers with the twist tie with the hanger slide rod returning the bound hangers to an at rest position after the tying is completed, wherein the hanger slide rod having a recess on a top surface for retaining the selected group of hangers in a secured manner.

2. A laundry tie-out station which comprises, a tying machine for binding a selected group of hangers together with a twist tie, a pneumatic linear slide unit mounted on a linear slide support yoke frame connected to the tying machine for drawing the selected group of hangers into the tying machine, a hanger pull-in safety boom is attached to a top of the pneumatic slide unit for assuring the selected group of hangers are pulled into the tying machine properly, a hanger slide rod assembly attached to the pneumatic linear slide unit for supporting the selected group of hangers, the hanger slide rod assembly comprises a hanger slide rod having a recess on a top surface for retaining the selected group of hangers in a secured manner, and a hanger nesting actuator for bunching the selected group of hangers together permitting the tying machine to tightly bind the hangers with the twist tie and the hanger slide rod assembly to return the bound hangers to an at rest position after the tying is completed.

3. A laundry tie-out station that incorporates a tying machine of the type having means for twist-tying articles, with said tying machine having an adjustable opening to receive articles to be tied within the opening, means for adjusting the opening to control a metered length of a twist-tie ribbon for tying objects of various sizes and means for adjusting the opening of the machine for centering objects of various sizes to be tied, in addition said tying machine specifically having a component mounting platform integral therewith, wherein an improvement incorporates additional elements for converting the tying machine into the laundry tie-out station, which comprises, a linear slide support yoke frame attached on top of the tying machine component mounting platform, a pneumatic linear slide unit, having a mounting face, with said slide unit disposed on the linear slide support yoke frame, for drawing a selected group of hangers containing laundered clothing suspended thereupon into the tying machine, a horizontally positioned recessed hanger slide rod assembly, attached to the pneumatic linear slide unit mounting face, for retaining the selected group of hangers, the recessed hanger slide rod assembly comprises a recessed hanger slide rod, a pneumatic system connected to the linear slide unit for actuating said linear slide unit drawing the recessed hanger slide rod into the tying machine and urging return of the recessed hanger slide rod back into an at rest position, a hanger pull-in safety boom is attached to a top of the pneumatic linear slide unit for assuring the selected group of hangers are pulled into the tying machine properly, and means for integrally controlling the tying machine including actuating said pneumatic system as selected by an operator bunching the selected group of hangers together and returning the recessed hanger slide rod to said at rest position after the tying machine has electromechanically completed binding the selected group of hangers together with a twist tie.

4. The laundry tie-out station as recited in claim 3 wherein said linear slide support yoke frame further comprises, a support column abutting and attached to the tying machine component mounting platform, a linear slide mounting plate resting on the support column, a cross member plate connected to the slide mounting plate and a pair of side support plates interfacing with sides of the cross member plate and each side of the tying machine component mounting platform providing a suitable raised surface for mounting the pneumatic linear slide unit.

5. The laundry tie-out station as recited in claim 3 wherein said pneumatic linear slide unit further comprises, a double acting piston with hydraulic shock absorbers providing end position cushioning.

6. The laundry tie-out station as recited in claim 3 wherein said hanger slide rod further comprises, a hanger support plate rigidly connected to said linear slide unit, a hanger extension plate attached to the hanger support plate forming an angle bracket, a spacer plate contiguously engaging the hanger extension plate and the recessed hanger slide rod attached to a top surface of the spacer plate with a recess of said recessed hanger slide rod located on a top surface having sufficient depth to retain the selected group of hangers securely.

7. The laundry tie-out station as recited in claim 3 further comprising a hanger nesting actuator for bunching the selected group of hangers together permitting the tying machine to bind the selected group of hangers securely together with a twist tie.

8. The laundry tie-out station as recited in claim 7 wherein said hanger nesting actuator further comprises, a pneumatic cylinder having a cylinder mounting base thereon which includes a pair of self-lubricating bushings with the cylinder mounting base configured to attach the pneumatic cylinder under the tying machine component mounting platform, a ram mounting plate having an opposed pair of stabilizing arms extending therefrom attached to a ram of the pneumatic cylinder also a bunching angle bracket connected on an upper surface of the ram mounting plate with the stabilizing arms penetrating the cylinder mounting base self-lubricating bushings such that when the cylinder is actuated by the pneumatic system the ram forces the bunching angle bracket into contact compressing the selected group of hangers together permitting the tying machine to bind the selected group of hangers tightly together with a twist tie.

9. The laundry tie-out station as recited in claim 8 wherein said pneumatic system further comprises, a pneumatic hose for connection to a compressed air source, a pneumatic quick connect hose coupling attached to the pneumatic hose, a pneumatic ball valve connected to the quick connect hose coupling, a filter regulator in communication with the pneumatic ball valve, a pneumatic linear slide unit valve interfacing with the filter regulator controlling movement of the linear slide unit, and simultaneously said filter regulator interfacing with a hanger nesting actuator valve thereby controlling the movement of the hanger nesting actuator forcing the bunching angle bracket into contact with the selected group of hangers together permitting the tying machine to bind the hangers tightly together with a twist tie.

10. The laundry tie-out station as recited in claim 9 wherein said means for integrally controlling the tying machine further comprises, a momentary foot switch electrically connected to a first time delay relay and the first time delay relay electrically connected to the pneumatic linear slide unit valve such that when an operator presses down on the foot switch the pneumatic linear slide unit valve energizes the linear slide unit bringing the selected group of hangers into contact with the tying machine placing a twist tie ribbon around the selected group of hangers and, after the first time delay relay has timed out, the linear slide unit returns to its at rest position.

11. The laundry tie-out station as recited in claim 9 wherein said means for integrally controlling the tying machine further comprises, a hanger nesting actuator switch in series with a second time delay relay and the hanger nesting actuator valve such that when the pneumatic linear slide unit draws the selected group of hangers into the tying machine the hanger nesting actuator switch energizes the hanger nesting actuator valve permitting the hanger nesting actuator to urge the hangers together allowing the tying machine to twist a tie ribbon around the selected group of hangers and, after the second time delay relay has timed out, the hanger nesting actuator returns to its at rest position.

12. The laundry tie-out station as recited in claim 3 further comprising a front support rod and a rear support rod attached under the tying machine for mounting the laundry tie-out station to building support beams.

13. The laundry tie-out station as recited in claim 3 further comprising a right upper guide plate attached to the linear slide support yoke frame and a left upper guide plate attached to the linear slide support yoke frame for guiding the recessed hanger slide rod over the tying machine component mounting platform to preclude contact with elements mounted thereon.

14. The laundry tie-out station as recited in claim 3 further comprising a hanger nesting actuator shield attached under the tying machine component mounting platform to preclude contact with elements mounted thereon.

15. The laundry tie-out station as recited in claim 3 further comprising a tying machine integral control switch and a hanger nesting switch disposed above the linear slide support yoke frame electrical control sequential function of the tying machine and the tie-out station.

16. The laundry tie-out station as recited in claim 3 further comprising a replacement front cover on the tying machine allowing space to house the addition of the laundry tie-out station improvement.

17. The laundry tie-out station as recited in claim 3 further comprising a replacement rear cover on the tying machine allowing space to house the addition of the laundry tie-out station improvement, said rear cover having a plurality of louvers on a top surface to provide air circulation within the tying machine.

18. The laundry tie-out station as recited in claim 17 further comprising a relocated control box attached to a rear portion of the replacement rear cover.

19. The laundry tie-out station as recited in claim 3 further comprising means to mount a roll of twist tie wire in a horizontal position.

* * * * *